US009958215B2

(12) United States Patent
Buckrell et al.

(10) Patent No.: US 9,958,215 B2
(45) Date of Patent: May 1, 2018

(54) HEAT TRANSFER SURFACE WITH NESTED TABS

(71) Applicant: Dana Canada Corporation, Oakville (CA)

(72) Inventors: Andrew Buckrell, Kitchener (CA); Michael Bardeleben, Oakville (CA)

(73) Assignee: Dana Canada Corporation, Oakville, Ontario (CA)

( * ) Notice: Subject to any disclaimer, the term of this patent is extended or adjusted under 35 U.S.C. 154(b) by 753 days.

(21) Appl. No.: 14/195,982

(22) Filed: Mar. 4, 2014

(65) Prior Publication Data

US 2014/0262170 A1 Sep. 18, 2014

Related U.S. Application Data

(60) Provisional application No. 61/787,261, filed on Mar. 15, 2013.

(51) Int. Cl.

| | |
|---|---|
| ***F28D 1/04*** | (2006.01) |
| ***F28D 1/02*** | (2006.01) |
| ***F28F 13/12*** | (2006.01) |
| ***F28F 1/20*** | (2006.01) |
| ***F28F 1/30*** | (2006.01) |
| ***F28F 3/02*** | (2006.01) |
| ***F28F 1/12*** | (2006.01) |

(Continued)

(52) U.S. Cl.

CPC ..... *F28F 3/027* (2013.01); *F28F 1/128* (2013.01); *B21D 53/085* (2013.01); *F28D 1/0333* (2013.01); *F28D 1/0375* (2013.01); *F28F 1/325* (2013.01)

(58) Field of Classification Search

CPC ..... F28F 1/128; F28F 1/325; F28D 1/0375; B21D 53/085

USPC ..... 165/151, 152, 109.1, 181, 182

See application file for complete search history.

(56) References Cited

U.S. PATENT DOCUMENTS 1,416,570 A 5/1922 Modine
2,526,243 A * 10/1950 Lange ..... F25D 17/067 165/125

(Continued)

FOREIGN PATENT DOCUMENTS

CN 1504714 A 6/2004
CN 201600048 U 10/2010

(Continued)

OTHER PUBLICATIONS

Translation of German Patent Document No. DE 202004013882 U1 entitled Translation-DE 202004013882 U1.*

(Continued)

*Primary Examiner* — Len Tran
*Assistant Examiner* — Paul Alvare
(74) *Attorney, Agent, or Firm* — Marshall & Melhorn, LLC

(57) ABSTRACT

A heat transfer surface for a heat exchanger has a corrugated member having parallel spaced apart ridges and planar fin surfaces extending the ridges. Tabs are formed in the planar fin surfaces for forming counter-rotating vortices in the fluid flowing over the heat transfer surface, the tabs being lifted out of the surface of the planar fin surface and extending into or nesting within the openings formed by the corresponding tabs in the adjacent planar fin surface so as to achieve high fin density.

15 Claims, 10 Drawing Sheets

(51) Int. Cl.

| | |
|---|---|
| *F28F 1/32* | (2006.01) |
| *F28D 1/03* | (2006.01) |
| *B21D 53/08* | (2006.01) |

(56) References Cited

U.S. PATENT DOCUMENTS

| | | | | | |
|---|---|---|---|---|---|
| 3,223,153 | A * | 12/1965 | Simpelaar | B21D 53/085 | 165/152 |
| 3,291,206 | A | 12/1966 | Nicholson | | |
| 3,631,922 | A * | 1/1972 | Ponziani | F28F 1/325 | 165/151 |
| 3,844,336 | A | 10/1974 | Anderson | | |
| 4,469,167 | A | 9/1984 | Itoh et al. | | |
| 4,676,934 | A | 6/1987 | Seah | | |
| 4,727,907 | A | 3/1988 | Duncan | | |
| 4,787,442 | A * | 11/1988 | Esformes | F28F 1/12 | 165/151 |
| 4,796,694 | A | 1/1989 | Ikuta et al. | | |
| 4,817,709 | A | 4/1989 | Esformes | | |
| 4,984,626 | A | 1/1991 | Esformes et al. | | |
| 5,042,576 | A | 8/1991 | Broadbent | | |
| 5,099,914 | A | 3/1992 | Reifel | | |
| 5,240,070 | A | 8/1993 | Ryan | | |
| 5,337,807 | A | 8/1994 | Ryan | | |
| 5,360,060 | A | 11/1994 | Tanaka et al. | | |
| 5,361,828 | A | 11/1994 | Lee | | |
| 5,538,700 | A | 7/1996 | Koves | | |
| 5,730,213 | A | 3/1998 | Kiser et al. | | |
| 6,026,892 | A | 2/2000 | Kim et al. | | |
| 6,820,682 | B2 | 11/2004 | Hayashi et al. | | |
| 6,907,919 | B2 | 6/2005 | Zhang | | |
| 7,040,386 | B2 * | 5/2006 | Shimoya | F28F 1/022 | 165/153 |
| 7,156,163 | B2 | 1/2007 | Heng-I et al. | | |
| 2005/0045314 | A1 * | 3/2005 | Elbourini | F28D 1/05366 | 165/152 |
| 2005/0173100 | A1 * | 8/2005 | Takai | F28F 9/0224 | 165/149 |
| 2006/0048921 | A1 | 3/2006 | Usui et al. | | |
| 2006/0266503 | A1 * | 11/2006 | Yamauchi | F28F 1/128 | 165/152 |
| 2007/0144711 | A1 | 6/2007 | Rausing | | |
| 2007/0235172 | A1 | 10/2007 | Asano et al. | | |
| 2008/0047696 | A1 * | 2/2008 | Sperandei | F28F 1/128 | 165/109.1 |
| 2009/0014159 | A1 | 1/2009 | Nishino et al. | | |
| 2010/0059215 | A1 | 3/2010 | Kolb et al. | | |
| 2011/0139414 | A1 | 6/2011 | Ghosh et al. | | |
| 2012/0125578 | A1 | 5/2012 | Persson | | |
| 2012/0125583 | A1 | 5/2012 | Persson | | |
| 2012/0152500 | A1 | 6/2012 | Kao et al. | | |

FOREIGN PATENT DOCUMENTS

| | | | | |
|---|---|---|---|---|
| CN | 102478369 | A | 5/2012 | |
| DE | 202004013882 | * | 1/2006 | F28F 1/126 |
| EP | 0622602 | A2 | 11/1994 | |
| JP | 55075190 | | 6/1980 | |
| JP | 08303981 | A | 11/1996 | |
| JP | 2003227691 | A | 8/2003 | |
| JP | 2009236469 | A * | 10/2009 | |
| WO | 1940064 | A2 | 12/2001 | |
| WO | 2004030809 | | 4/2004 | |
| WO | 2005075917 | A1 | 8/2005 | |

OTHER PUBLICATIONS

Translation of JP 2009236469 A entitled Translation-JP 2009236469 A.*

International Search Report with Written Opinion for PCT/CA2014/050619.

English Abstract of EP0622602A2.

English Abstract of JP08303981A.

English Language Abstract of Japanese Publication No. 55-075190.

ST. Tiggelbeck, N.K. Mitra and M. Fiebig, Experimental investigations of heat transfer enhancement and flow losses in a channel with double rows of longitundinal vortex generators, Int. J. Heat Mass Transfer 36 (1993) 2327-2337.

Chi-Chuan Wang, Jerry Lo, Yur-Tsai Lin, Min-Sheng Liu, Flow visualization of wave-type vortex generators having inline fin-tube arrangement, International Journal of Heat and Mass Transfer 45 (2002) 1933-1944.

* cited by examiner

HEAT TRANSFER SURFACE WITH NESTED TABS

CROSS-REFERENCE TO RELATED APPLICATION

This application claims priority to and the benefit of U.S. Provisional Patent Application No. 61/787,261, filed Mar. 15, 2013 under the title HEAT TRANSFER SURFACE WITH NESTED TABS. The content of the above patent application is hereby expressly incorporated by reference into the detailed description of the present application.

TECHNICAL FIELD

The invention relates to heat exchangers, and in particular, to heat transfer surfaces, such as fins, used to increase heat transfer performance in heat exchangers.

BACKGROUND

In heat exchangers, particularly of the type used to heat or cool fluids, it is common to use heat transfer surfaces, such as fins, positioned between, adjacent to and/or inside fluid flow passages in the heat exchanger to increase heat transfer performance. Various types of heat transfer surfaces or fins are known. One common type of heat transfer surface or fin is a corrugated fin consisting of sinusoidal or rectangular corrugations extending in rows along the length or width of the heat exchanger plates or tubes, the heat transfer surface being positioned between or adjacent to the heat exchanger tubes or stacked plates that make up the heat exchanger. In order to further increase the heat transfer performance of the heat transfer surface or fin, it is known in the art to form a series of "slits" or "louvers" in the planar surfaces of the heat transfer surfaces or fins. The slits or louvers serve to disrupt boundary layer growth along the length of the planar surfaces and increase mixing in the fluid flowing over/through the heat transfer surface in an effort to increase overall heat transfer performance of the heat exchanger.

While positioning a heat transfer surface or fin between the tubular members or stacked plates of the heat exchanger increases heat transfer performance by providing additional surface area for heat transfer, heat transfer surfaces are also known to increase pressure drop through the fluid channel in which the heat transfer surface is located. Therefore while louvered fins and other heat transfer surfaces with heat transfer augmenting features are known, there is a continual need to provide improved heat transfer surfaces that increase heat transfer performance without negatively impacting pressure drop across the fin or heat transfer surface whether it is positioned between the tubular members or within the tubular members of a heat exchanger.

SUMMARY OF THE PRESENT DISCLOSURE

In accordance with an example embodiment of the present disclosure, there is provided a heat transfer surface for a heat exchanger comprising a corrugated member having a plurality of parallel, spaced apart upper and lower ridges and planar fin surfaces extending therebetween; each corrugation of said corrugated member comprising either an upper or lower ridge and two planar fin surfaces extending in the same direction from the corresponding upper or lower ridge; the planar fin surfaces being formed with a plurality of spaced apart tabs, each tab having an attached base and a free end projecting out of the plane of the corresponding planar fin surface; a plurality of openings formed in the planar fin surfaces, the plurality of openings formed by the tabs projecting out of the planar fin surface; the free ends of the tabs formed in one of the planar fin surfaces extending into or through the openings formed in an adjacent planar fin surface.

In accordance with another example embodiment of the present disclosure there is provided a heat exchanger comprising a plurality of stacked tubular members extending in spaced apart generally parallel relationship; a first set of fluid flow passages defined by said plurality of stacked tubular members; a second set of fluid flow passages formed between adjacent tubular members; a first manifold in communication with said first set of fluid flow passages; a second manifold in communication with said first set of fluid flow passages; and a plurality of heat transfer surfaces disposed in said second set of fluid passages between adjacent tubular members wherein each of the heat transfer surfaces comprises a corrugated member having a plurality of parallel, spaced apart upper and lower ridges and planar fin surfaces extending therebetween; each corrugation of said corrugated member comprising either an upper or lower ridge and two planar fin surfaces extending in the same direction from the corresponding upper or lower ridge; the planar fin surfaces being formed with a plurality of spaced apart tabs, each tab having an attached base and a free end projecting out of the plane of the corresponding planar fin surface; a plurality of openings formed in the planar fin surfaces, the plurality of openings formed by the tabs projecting out of the planar fin surface; the free ends of the tabs formed in one of the planar fin surfaces extending into the openings formed in an adjacent planar fin surface.

BRIEF DESCRIPTION OF THE DRAWINGS

Exemplary embodiments of the present disclosure will now be described, by way of example, with reference to the accompanying drawings, in which.

DETAILED DESCRIPTION OF EXEMPLARY EMBODIMENTS

Figure 1:
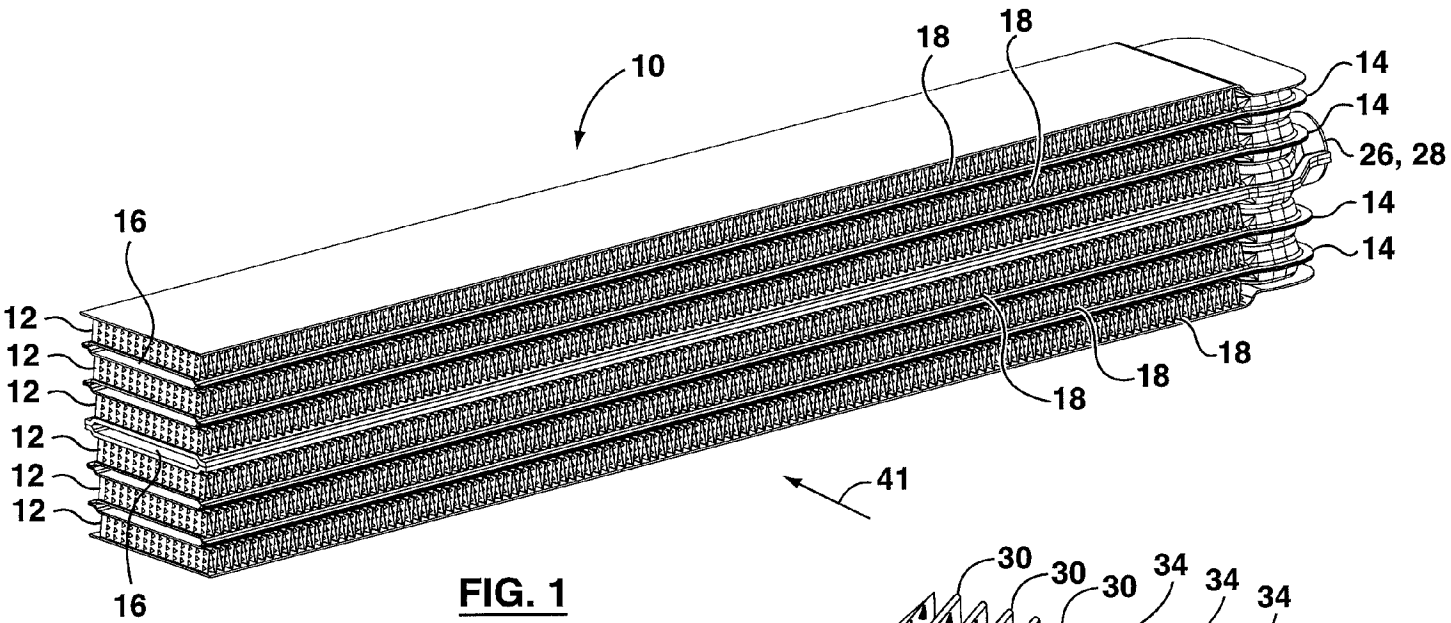
FIG. 1 is a perspective view of a heat exchanger incorporating a heat transfer surface according to an exemplary embodiment of the present disclosure.

Referring to FIG. 1, there is shown a heat exchanger assembly 10 incorporating a heat transfer surface 12 according to an exemplary embodiment of the present disclosure. The heat exchanger assembly 10 includes a plurality of stacked tubular members 14 that extend in spaced apart, generally parallel relationship to each other. The plurality of stacked tubular members 14, together define a first set of flow passages 16 therethrough for the flow of a first fluid through the heat exchanger 10. A second set of fluid passages 18 is defined between adjacent tubular members 14 for the flow of a second fluid, such as air, through the heat exchanger 10. While tubular members 14 may each be formed by a single tubular element, they may also be formed by a pair of mating upper and lower plates and, therefore, may also be referred to as plate pairs. The tubular members (or plate pairs) 14 are formed with raised embossments or boss portions 24 each having an opening formed therein which serves as an inlet/outlet opening for the flow of the first fluid through the tubular members 14. The boss portions 24 of one tubular member 14 aligning and mating with the boss portions 24 on the adjacent tubular member 14 in the stack of tubular members to form inlet/outlet manifolds 26, 28 (only one of which is shown in the drawing). In some embodiments, the boss portions 24 may both be positioned at one longitudinal end of the tubular members 14 resulting in a generally U-shaped flow path through the tubular member 14 while in other embodiments one boss portion 24 may be located at respective ends of the tubular members 14 thereby forming a heat exchanger 10 with a manifold located at each of the respective ends. Furthermore, it will be understood that while heat exchanger 10 is shown as a heat exchanger formed of a plurality of stacked tubular members 14 with integral inlet/outlet manifolds 26, 28, heat exchanger 10 may also be formed by tubular members affixed to externally mounted inlet/outlet headers to supply the stack of tubular members 14 with fluid and to receive fluid from them. It will also be understood that while the second set of fluid passages 18 are shown as being open for the flow of a fluid such as freestream air therethrough, the second set of fluid passages 18 could also be fed by a common manifold for the inletting/discharging of a second fluid therethrough. Accordingly, it will be understood that the present disclosure is not intended to be limited to heat exchangers where the second set of fluid passages 18 is open to freestream air as would be understood in the art.

In the subject embodiment, heat transfer surfaces 12 are attached to the outside surfaces of tubular members 14 and located between the stacked, spaced apart tubular members 14 in the second set of fluid passages 18 formed therebetween. Heat transfer surface 12 is in the form of a corrugated member having generally, parallel spaced apart upper and lower ridges 30, 32 and generally planar fin surfaces 34 extending between the upper and lower ridges 30, 32. Each corrugation of the corrugated member is generally defined by an upper or lower ridge 30, 32 and two planar surfaces 34 extending in the same generally vertical direction from the upper or lower ridge 30, 32. Each planar fin surface 34 also defines a first or inner surface 33 and a second or outer surface 35, although whether the first or second surface is considered an inner surface or an outer surface depends on whether one is considering a corrugation based on an upper ridge 30 with downwardly depending planar fin surfaces 34 or a corrugation based on a lower ridge 32 with upwardly extending planar fin surfaces 34. For the purpose of the embodiments described in the present disclosure, reference is made to the planar fin surface 34 defining an inner surface 33 and an outer surface 35 with regard to a corrugation based on an upper ridge 30, however, it will be understood that surfaces 33, 35 would be reversed when considering a corrugation based on a lower ridge 32.

As shown in FIG. 3, the upper and lower ridges 30, 32 are rounded with the planar fin surfaces 34 being generally upright or vertical and parallel to each other. However, it will be understood that the upper and lower ridges 30, 32 can also be generally flat surfaces depending upon the particular embodiment of the heat transfer surface 12 and the heat exchanger 10, and that the planar fin surfaces 34 may also be formed so as to extend at an angle away from a vertical axis through the corresponding upper or lower ridge 30, 32.

As shown in the drawings, the planar fin surfaces 34 are formed with a series of projections in the form of delta wing tabs or triangular tabs 36 that project or extend out of the surface of the planar fin surface 34. As is generally understood in the art, a "delta wing" refers to a triangular-shaped tab wherein the triangular point or tip 38 is detached from and lifted out of the planar fin surface 34 in which it is formed with the tip 38 being oriented upstream from the attached base 40 of the tab 36. By lifting the triangular tips 38 out of the plane of the planar fin surface 34 to form an angle with said planar surface, a corresponding opening 39 is formed in the planar fin surface 34.

Figure 2:
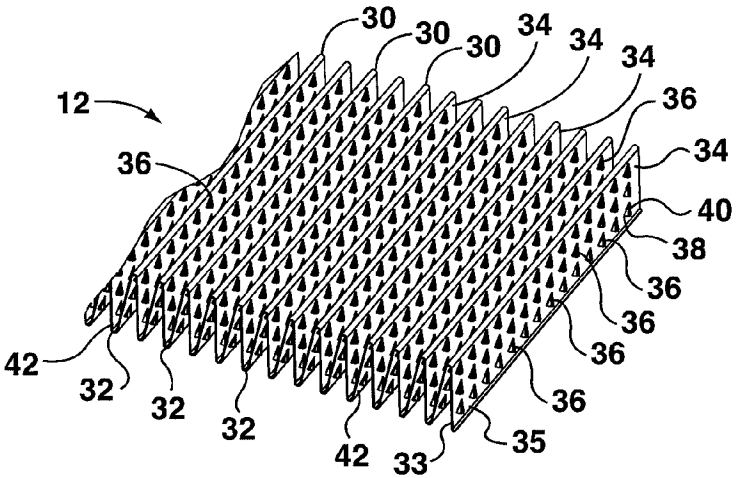
FIG. 2 is a partial perspective view of a portion of the heat transfer surface shown in FIG. 1.
Figure 3A:
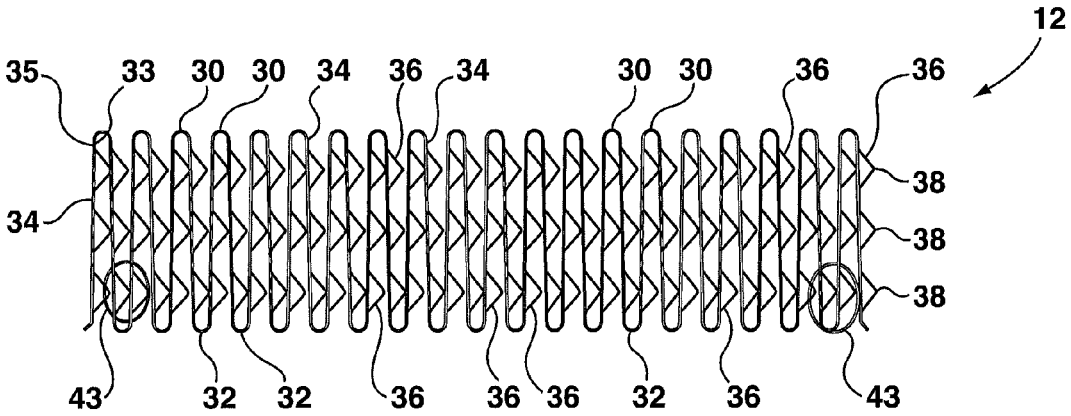
FIG. 3A is a front elevation view of the heat transfer surface shown in FIG. 2 showing nesting of the tab tips.
Figure 3B:
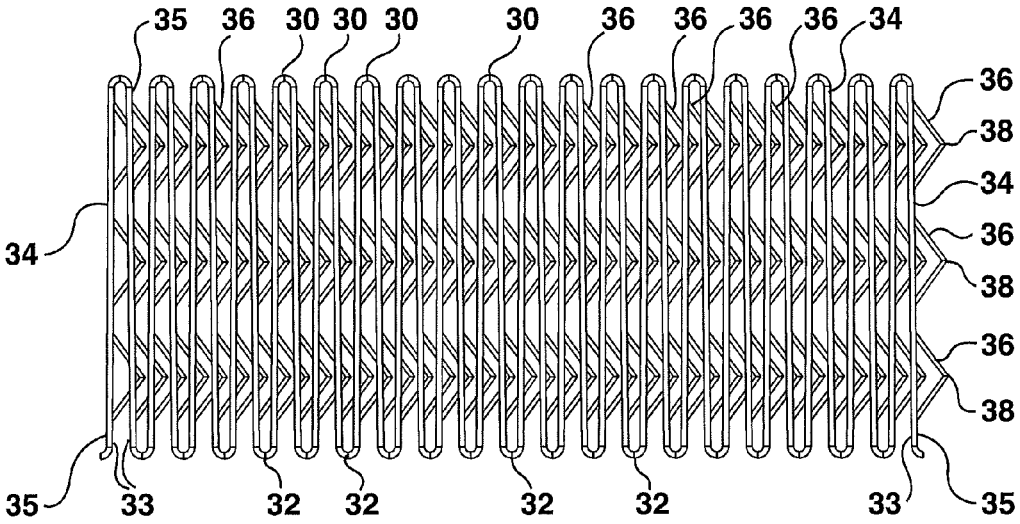
FIG. 3B is a front elevation view of the heat transfer surface shown in FIG. 2 showing the nesting of the tab tips through the corresponding openings formed in the adjacent planar fin surface.
Figure 4:
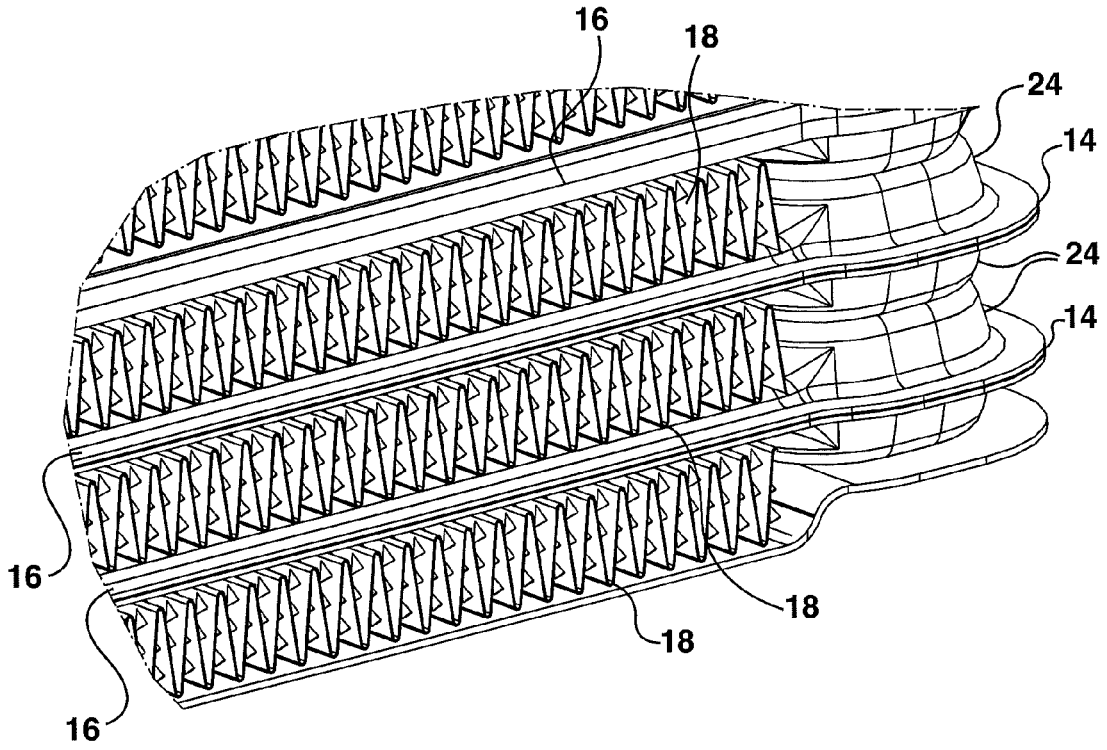
FIG. 4 is a detail perspective view of a portion of the heat exchanger shown in FIG. 1.

In the subject exemplary embodiment shown primarily in FIGS. 2-4, the triangular tabs 36 are all positioned with their tips 38 pointed in the same, upstream direction. The triangular tabs 36 in the heat transfer surface 12 are also formed so that all of the tips 38 project or extend out of their respective planar fin surface 34 in the same direction. More specifically, as shown most clearly in FIG. 3, when the heat transfer surface 12 is viewed from its front or leading edge 42 with respect to the direction of incoming flow represented by arrow 41 in FIGS. 1 and 2, all of the triangular tabs 36 are directed in the same general direction, i.e. to the right in the specific exemplary embodiment illustrated in the drawing. It will be understood, however, that the triangular tabs 36 could also all be directed in the opposite direction, i.e. towards the left, depending upon the particular orientation/position of the heat transfer surface 12 and in other embodiments could be directed in the same direction but at different angles, or could be directed in different directions depending upon the specific embodiment of the heat transfer surface 12. In the subject embodiment, when considering an individual corrugation, it will be understood that the triangular tabs 36 on a first of the two planar fin surfaces 34 that form the corrugation project towards the inside surface 33 of the corresponding planar fin surface 34 while the triangular tabs on the second of the two planar fin surfaces 34 project towards the outside surface 35 of the corresponding planar fin surface 34.

Figure 13:
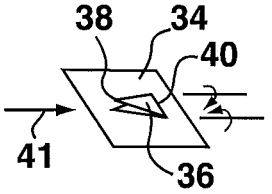
FIG. 13 is a detail schematic drawing illustrating the counter-rotating vortices formed by the triangular tabs of the heat transfer surface according to the present disclosure.

The triangular tabs 36 are bent or project out of the plane of their respective planar fin surface 34 and are positioned at an angle of attack to the incident flow (see arrow 41 in FIG. 1 representative of direction of fluid flow over the heat transfer surface 12). By having the triangular tabs 36 project out of the surface of the planar fin surface 34 with the tip 38 positioned at an angle of attack to the incident flow, a pair of counter-rotating vortices (shown schematically in FIG. 13) are formed within the fluid flowing over the planar fin surface 34, which persist far downstream along the length of the planar fin surface 34. By introducing counter-rotating vortices within the fluid travelling over the planar fin surfaces 34, boundary layer thickness within the fluid is minimized which serves to increase the overall heat transfer performance of the heat transfer surface 12.

As shown in FIGS. 2-4, the heat transfer surface 12 is also preferably constructed so that the tips 38 of the triangular tabs 36 from one planar fin surface 34 extend into or are nested within the openings 39 formed in the adjacent planar fin surface 34 by the triangular tabs 36 formed therein. The tips 38 of the triangular tabs 36 may also extend through the openings 39 in the adjacent planar fin surface 34 so that the tips 38 project beyond the outer surface 35 of the adjacent planar fin surface 34 as shown clearly in FIG. 3B. The tips 38 may also simply nest within the corresponding openings 39 in the adjacent planar fin surface 34 as opposed to extending all the way through the openings 39 as shown, for instance in the encircled areas 43 in FIG. 3A. The nesting of the triangular tabs 36 between adjacent planar fin surfaces 34, as shown primarily in FIGS. 3A and 3B, allows for increased fin density within the heat transfer surface 12 since the planar fin surfaces 34 can be positioned closer together. It has been found that the nesting of the triangular tabs 36 appears to increase the overall heat transfer performance without appearing to have an adverse effect on pressure drop as is common in some known louvered fin designs. Without taking advantage of the nesting of the tabs 36, it has been found that any performance increase in the heat transfer surface 12 is limited by the fin density/spacing, the number of tabs 36 provided, the size of the tabs 36 as well as the angle of attack at which the tabs 36 are positioned with respect to the incoming flow. While enhanced performance characteristics relating to overall heat transfer performance and pressure drop alone are desirable and appear to represent potential advantages over known heat transfer surfaces with plain fin surfaces, the increased fin density achievable with the subject heat transfer fin 12 due to the nesting of the triangular tabs 36 between adjacent planar fin surfaces 34 has been found to potentially give rise to improved heat transfer performance beyond what is typically found with conventional, known louvered fins.

Figure 14:
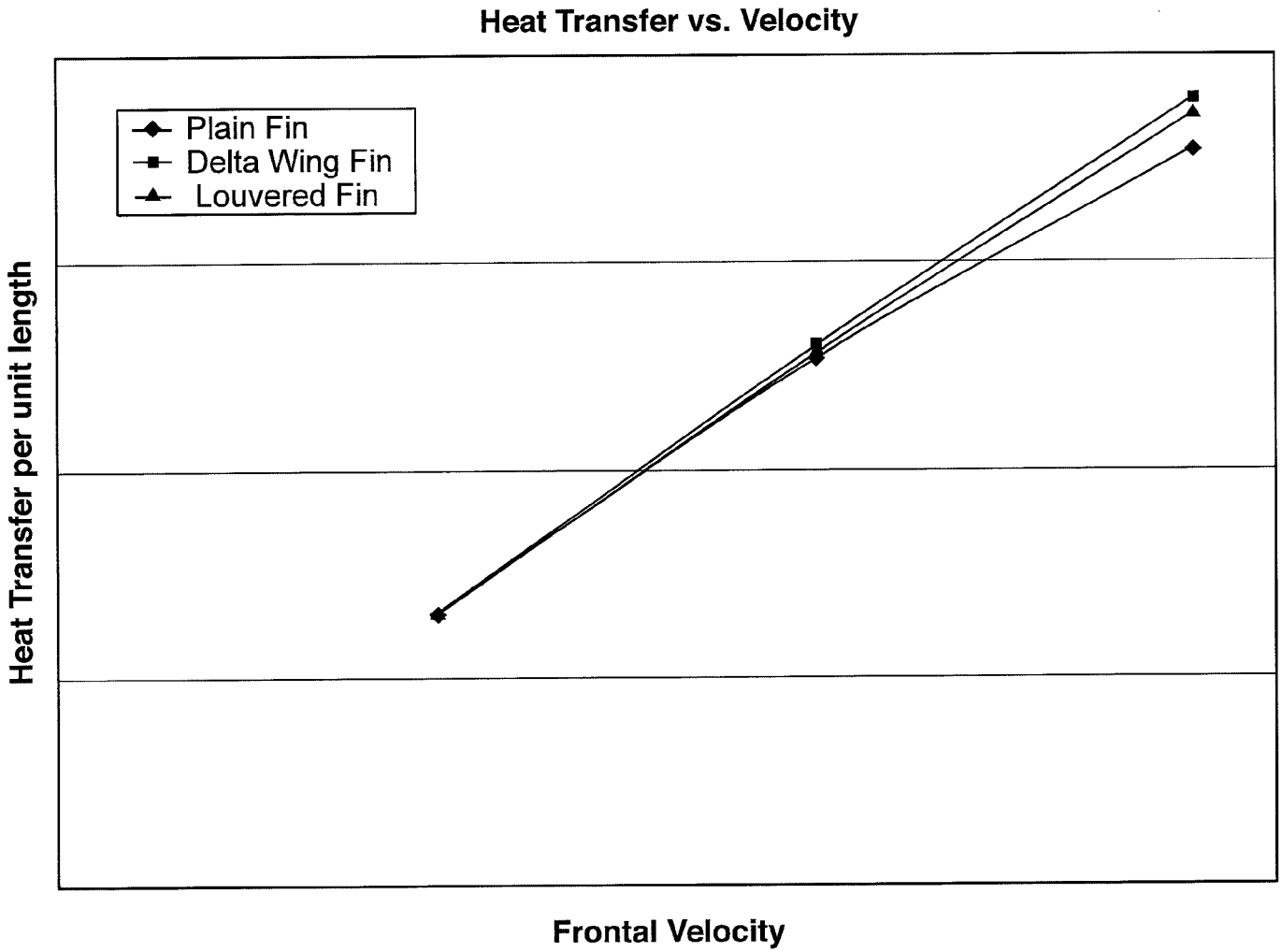
FIG. 14 is a graph showing the relationship between heat transfer performance and fluid velocity for the heat transfer surface according to the present disclosure as compared to other known fin structures wherein the curve is representative of the performance of the respective heat transfer surface or known fin structure very near to its respective current manufacturing limit for fin density.
Figure 15:
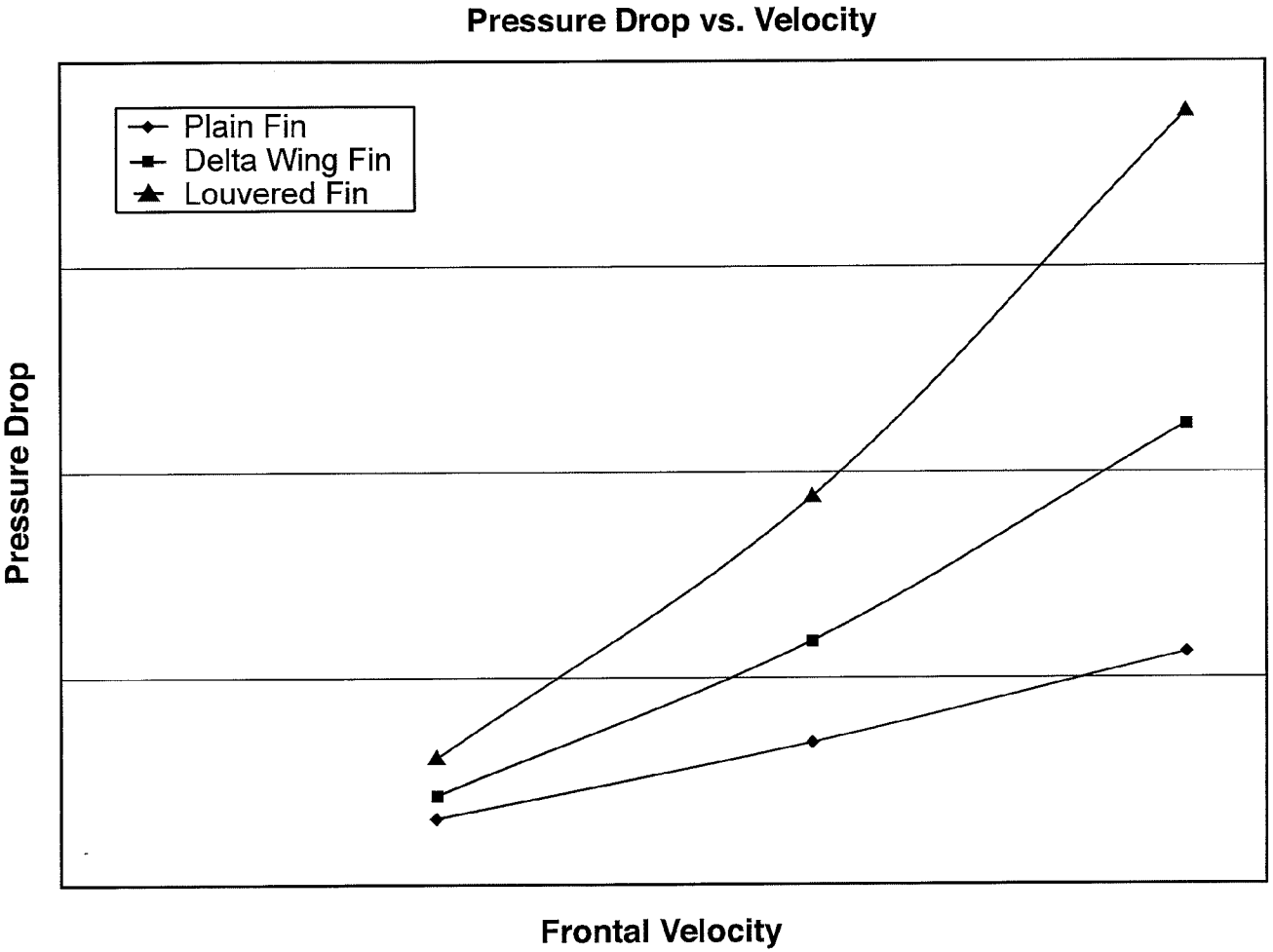
FIG. 15 is a graph showing the relationship between pressure drop and fluid velocity for the heat transfer surface according to the present disclosure as compared to other known fin structures wherein the curve is representative of the performance of the respective heat transfer surface or known fin structure very near to its respective current manufacturing limit for fin density.

It has also been found that the nesting of the delta wing or triangular tabs 36 may not interfere with or may not have an adverse effect on formation of the flow patterns, e.g. the formation of counter-rotating vortices, that appear to contribute to potential heat transfer enhancement, which appears to indicate that the increased fin density of the subject heat transfer surface does not significantly decrease the overall effectiveness of the fin as is sometimes found with other, known fins or heat transfer surfaces. FIGS. 14 and 15 demonstrate findings relating to the performance of the heat transfer surface 12 according to the present disclosure as compared to known plain fin and louvered fin structures where the curves are representative of the performance of the respective heat transfer surface or known fin structure very near to its respective manufacturing limit for fin density, the subject heat transfer surface 12 being referred to as "delta wing fin" in the attached graphic representations. As shown in FIGS. 14 and 15, the subject heat transfer surface 12 offers improved heat transfer performance over both the known plain fin and the known louvered fin structures for the same flow velocity while also offering improved pressure drop as compared to the known louvered fin structures each at their respective upper manufacturing limit for fin density. Accordingly, based on the above-mentioned results, it has been found that the heat transfer surface 12 according to the present disclosure outperforms the known louvered fin structure in both pressure drop and heat transfer with the louvered fin structure at its furthest limit of attainable performance (i.e. at its maximum fin density).

While the exemplary embodiment shown primarily in FIGS. 1-4 shows the heat transfer surface 12 being formed with three rows of triangular tabs 36 that extend along the length of the planar fin surface 34 with all of the triangular tabs 36 being arranged inline with each other (i.e. one behind the other) with all of the triangular tips 38 pointed in the same direction relative to the incoming flow (i.e. unidirectional triangular tabs) as is shown most clearly in FIGS. 2 and 3, it will be understood that the exact number of rows of tabs will depend on the actual size of fin or heat transfer surface being used based on the particular application. For instance, certain fins, such as fins with a height of 2.5-3.0 mm, may not accommodate three rows of triangular tabs 36 while other larger fins may be able to accommodate more than three rows of triangular tabs 36. Accordingly, it will be understood that the three rows of triangular tabs 36 shown in the drawings is intended to be illustrative and not limiting to the heat transfer surface 12 described herein. Various other arrangements of the triangular tabs 36 are also contemplated within the scope of the present disclosure as will be described in further detail below.

Figure 5:
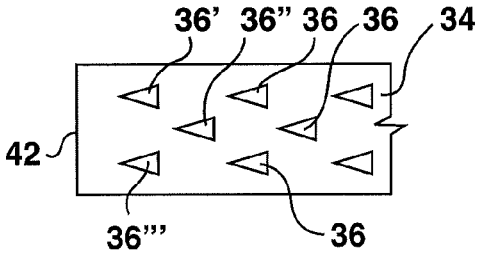
FIG. 5 is a schematic drawing illustrating an alternate embodiment of the heat transfer surface tab pattern according to the present disclosure.

Referring now to FIG. 5, there is shown another exemplary embodiment of the heat transfer surface 12 according to the present disclosure wherein the rows of triangular tabs 36 formed in the planar fin surfaces 34 are arranged in a staggered pattern as opposed to having all of the triangular tabs 36 arranged in line with each other. In the staggered arrangement, the triangular tabs 34 in each row are still arranged one behind the other, although the tabs 36 may be spaced farther apart from one another. In the embodiment shown, the first or uppermost row of triangular tabs 36 is formed so that the first triangular tab 36' is positioned generally at the leading edge 42 of the corresponding planar fin surface 34, e.g. in a first position. The subsequent or middle row of triangular tabs 36 is formed so that the first triangular tab 36" in that row is set back from the leading edge 42 of the planar fin surface 34 thereby creating a staggered pattern with respect to the first row of tabs 36. The third or final row of triangular tabs 36 shown is formed so as to mimic the formation or positioning of the first row of triangular tabs 36 with the first tab 36'" in the third row being positioned generally at the leading edge 42 of the planar fin surface 34. While the rows of triangular tabs 36 are shown in their staggered arrangement, the triangular tabs 36 can still be formed so as to nest within the openings 39 formed by the corresponding triangular tabs 36 in the adjacent planar fin surface 34. Accordingly, increased fin density can still be achieved with the triangular tabs 36 arranged in a staggered formation. While only three rows of triangular tabs 36 have been illustrated, it will be understood that the exact number of rows may vary depending upon the size of the fin surface and/or the particular application in which case the staggered pattern described above would repeat over the surface of the fin.

Figure 6:
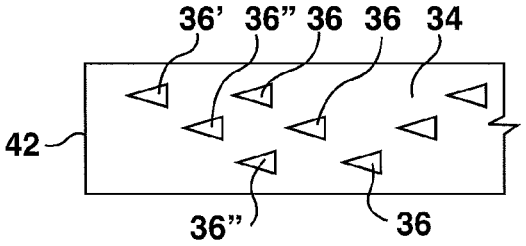
FIG. 6 is a schematic drawing illustrating another alternate embodiment of the heat transfer surface tab pattern according to the present disclosure.

Referring now to FIG. 6, there is shown another exemplary embodiment of the heat transfer surface 12 according to the present disclosure wherein the rows of triangular tabs 36 are formed in a cascaded pattern along the length of the planar fin surfaces 34. More specifically, in the cascaded arrangement, while the triangular tabs 36 in each individual row are essentially arranged in an in-line pattern (i.e. one behind the other), the spacing or gap formed between each individual tab 36 is larger or increased as compared to the first exemplary embodiment described above in connection with FIGS. 1-4. As described above, the first or uppermost row of triangular tabs 36 in the cascaded arrangement is formed so that the first triangular tab 36' is positioned generally at the leading edge 42, e.g. in a first position, of the corresponding planar fin surface 34 with the remaining tabs 36 positioned at spaced apart intervals behind this first tab 36' along the length of the planar fin surface 34. The subsequent or middle row of triangular tabs 36 is formed so that the first triangular tab 36" in that row is set back from the leading edge 42 of the planar fin surface 34 by a predetermined distance so that each tab 36 in the second row of triangular tabs 36 is positioned slightly downstream from the corresponding triangular tab 36 in the first row, with this pattern continuing along the length of the planar fin surface 34. The third or final row of triangular tabs 36 shown in FIG. 6 is formed so that the first tab 36'" in the third row is set back from the leading edge 42 of the planar fin surface 34 by another predetermined distance so that each tab 36 in the third row is positioned slightly downstream from the corresponding triangular tab 36 in the second or middle row with this pattern continuing along the length of the planar fin surface 34. As described above in connection with FIGS. 1-4, the tabs 36 (including tabs 36', 36" and 36'") are all lifted out of the plane of the planar fin surface so as to be positioned at an angle of attack with respect to the directing of incoming flow. The tabs 36 on one planar fin surface 34 are all bent or directed towards either the inside surface or outside surface of the planar fin surface 34 in order to achieve the nesting effect between adjacent planar fin surfaces 34. Accordingly, increased fin density can still be achieved with the triangular tabs 36 arranged in the described cascaded formation. Furthermore, it will be understood that the cascading pattern may continue beyond three rows of triangular tabs 36 and that the actual number of rows will vary depending upon the size of the planar fin surface 34 as well as the particular design and/or application of the heat transfer surface 12. As well, it will be understood that the spacing between the rows of triangular tabs 36 is not necessarily uniform and that distance between subsequent tabs 36 in a row may vary as shown, for example, in the first row of tabs 36 of FIG. 6 where the third tab 36 in the first row is spaced farther apart from the other tabs 36 in the same row. The non-uniform spacing between the tabs may be used to form varying patterns over the planar fin surface 34.

Figure 7:
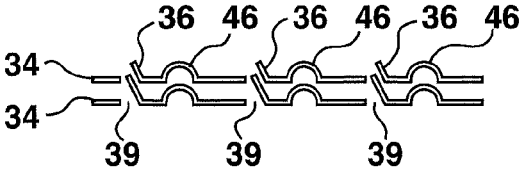
FIG. 7 is a schematic cross-sectional drawing through a portion of a planar fin surface of the heat transfer surface illustrating another alternate embodiment of the heat transfer surface according to the present disclosure.

Referring now to FIG. 7, there is shown yet another exemplary embodiment of the heat transfer surface 12 according to the present disclosure. In the subject embodiment, the triangular tabs 36 are combined with flow accelerating features 46 arranged behind each triangular tab 36 in an alternating pattern along the length of the planar fin surface 34. In the subject embodiment, the flow accelerating features 46 are in the form of "bumps" or rounded protrusions that project out of the surface of the planar fin surface 34, although any suitable flow accelerating feature is contemplated within the scope of the present disclosure. These features serve to accelerate the flow in the direction parallel to the vortices, hence increasing the vorticity. It will be understood that while the embodiment shown in FIG. 7 shows the triangular tabs 36 and the flow accelerating feature 46 protruding in the same direction out of the plane of planar fin surface 34, alternate embodiments may include flow accelerating features 34 protruding from alternate sides of the planar fin surface 34 and that the specific pattern may vary. However, it will be understood that all adjacent planar fin surfaces 34 would have the same pattern of tabs 36 and flow accelerating features 46 to provide for the nesting relationship between adjacent planar fin surfaces 34.

Figure 8:
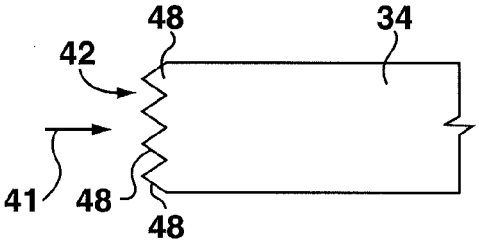
FIG. 8 is a schematic drawing illustrating another alternate embodiment of the heat transfer surface according to the present disclosure.
Figure 16:
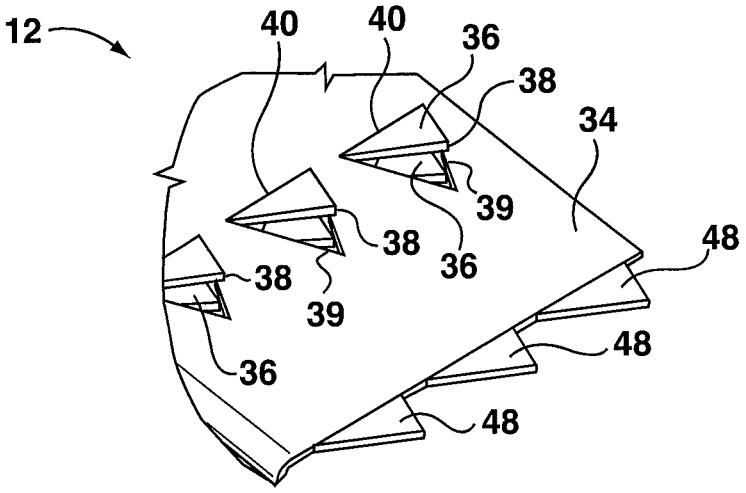
FIG. 16 is a top perspective view of a portion of a planar fin surface of a heat transfer surface with an angled saw-toothed leading edge.
Figure 17:
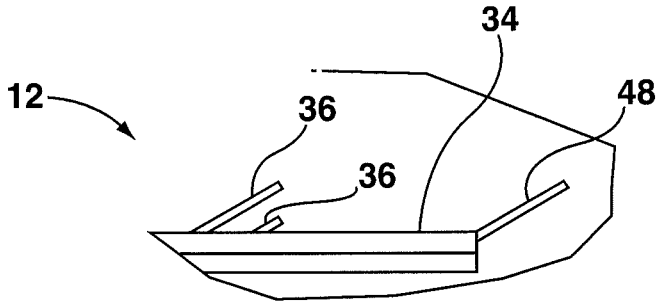
FIG. 17 is a side elevation view of the portion of the heat transfer surface shown in FIG. 16 as viewed from the upper or lower ridge of the corrugation.

Referring now to FIG. 8 there is shown another exemplary embodiment of the heat transfer surface 12 according to the present disclosure. As shown, in addition to having the triangular tabs 36 formed in the planar fin surfaces 34 of the corrugated heat transfer surface 34, it is also contemplated to modify the leading edge 42 of the fin or heat transfer surface 12 to incorporate triangular tabs 48 into the leading edge 42 of the heat transfer surface 12 in the form of a "saw-toothed" leading edge 42. The triangular tabs 48 formed in the leading edge 42 can be arranged so as to extend co-planar with each planar fin surface 34, as shown in FIG. 8, or can be bent outward (or inward) with respect to the corresponding planar fin surface 34 so as to be positioned at an angle of attack with respect to the incoming fluid flow as shown, for example, in FIGS. 16 and 17.

Figure 9:
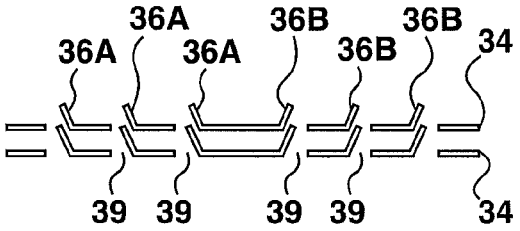
FIG. 9 is a schematic cross-sectional drawing through a portion of a planar fin surface of the heat transfer surface illustrating another alternate embodiment of the heat transfer surface according to the present disclosure.

Referring now to FIG. 9, there is shown another exemplary embodiment of the heat transfer surface 12 according to the present disclosure. In all of the embodiments described above the triangular tabs 36 have been shown as being arranged generally in-line with each other (i.e. one behind the other in each row of tabs along the length of the planar fin surface) and uni-directional (i.e. all triangular tabs point in the same direction relative to the flow direction on the planar fin surface 14). However, in other embodiments the triangular tabs 36 may be arranged so as to be "bi-directional" as shown, for example in FIG. 9. More specifically, the triangular tabs 36 in the planar fin surfaces 34 are formed so that the tabs 36A found in the first half of the planar fin surface 34, i.e. from the leading edge 42 of the heat transfer surface to the midway point of the heat transfer surface along the length of the corrugations, are arranged with their triangular tips all generally pointing in the direction of the incoming flow, although it will be understood that the tabs 36A themselves are arranged at an angle of attack with respect to the incoming flow. The triangular tabs 36B formed over the second half of the planar fin surface 34, i.e. from the midway point of the heat transfer surface along the length of the corrugations to the end edge are arranged so as to point in the opposite direction to the tabs 36A over the first half of the planar fin surface 34. More specifically, triangular tabs 36B are arranged so that the attached base 40 of the tab 36B is arranged upstream with respect to the triangular tip 38 and with respect to the direction of the incoming fluid flow. By having the triangular tabs 36A, 36B arranged in a bi-directional pattern over the planar fin surfaces 34, the heat transfer surface 12 is bi-directional since it can be used in either direction and have triangular tabs 36 with tips 38 arranged at an angle of attack with respect to the incoming flow.

Figure 10:
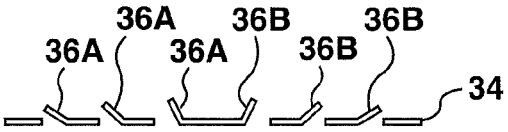
FIG. 10 is a schematic cross-sectional drawing through a portion of a planar fin surface of the heat transfer surface illustrating another alternate embodiment of the heat transfer surface according to the present disclosure.
Figure 18:
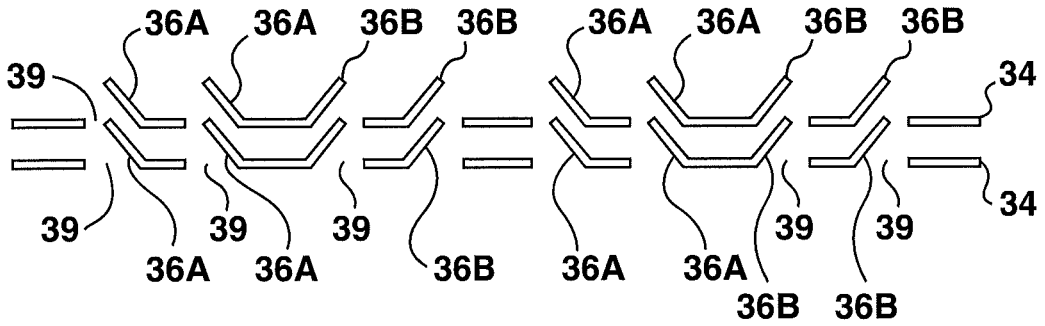
FIG. 18 is a schematic cross-sectional drawing through a portion of a planar fin surface of a heat transfer surface illustrating another example embodiment of the heat transfer surface according to the present disclosure.

FIG. 18 illustrates another embodiment of the heat transfer surface 12 similar to that described above in connection with FIG. 9. As shown, the heat transfer surface 12 can also be formed so as to have bi-directional triangular tabs 36A, 36B arranged in a different pattern than simply having half of the planar fin surface formed with delta wing or triangular tabs 36A with the triangular tips arranged upstream with respect to the attached base 40 with respect to the direction of incoming flow and with oppositely formed tabs 36B over the remaining half of the planar fin surface 34. More specifically, the triangular tabs 36 may be arranged in repeating and/or alternating patterns having a certain number of triangular tabs 36A arranged with the tips 38 pointing upstream followed by a certain number of triangular tabs 36B arranged with the tips 38 pointing downstream with respect to the incoming flow followed by another series of triangular tabs 36A arranged with their tips 38 pointing upstream. While FIG. 18 shows a section of a planar fin surface 34 of a heat transfer surface 12 with a repeating pattern of two upstream-pointing triangular tabs 36A followed by two downstream-pointing triangular tabs 36B followed by two upstream-pointing tabs 36A followed by two downstream-pointing tabs 36B, it will be understood that the exact number of tabs 36A, 36B can be varied and/or can be different from each other depending upon the specific application and/or design of the particular heat transfer surface 12. Accordingly, it will be understood that the embodiment shown in FIG. 18 is intended to be illustrative and not limiting. For instance, while the planar fin surface 34 may be provided with some triangular tabs 36A pointing upstream and some triangular tabs 36B pointing downstream, the tabs 36 do not necessarily need to be arranged in a repeating pattern and that various groupings of tabs 36A, 36B can be formed in the planar fin surface 34 over the length thereof. In addition to having the triangular tabs 36A, 36B arranged bi-directionally, the size and angle of attack of the tabs 36 may also be varied along the length of the planar fin surfaces 34 as shown schematically in FIG. 10.

Figure 11:
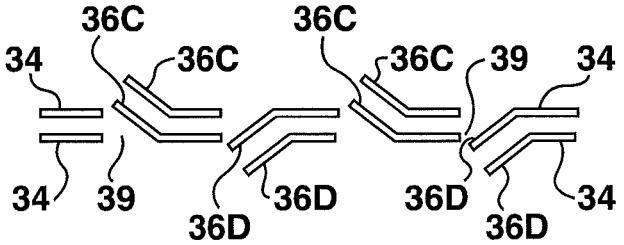
FIG. 11 is a schematic cross-sectional drawing through a portion of a planar fin surface illustrating yet another alternate embodiment of the heat transfer surface according to the present disclosure demonstrating the nesting of the tab tips when the heat transfer augmenting tabs are bent in alternating directions along the length of the fin surface.

Referring now to FIG. 11 there is shown another exemplary embodiment of the heat transfer surface 12 according to the present disclosure. In this embodiment, rather than having all of the triangular tabs 36 in one planar fin surface 34 being bent in the same or a single direction out of the plane of the planar fin surface 34 the triangular tabs 36 can also be formed so that the tabs 36 are bent in alternating directions as shown schematically in FIG. 11. More specifically, in this particular embodiment each row of triangular tabs 36 formed along the length of the planar fin surface 34 comprises a first set of tabs 36C that are bent or lifted out of the plane of the planar fin surface 34 in a first direction (i.e. towards either the inside surface 33 or outside surface 35 of the planar fin surface 34) that are spaced apart along the length of the planar fin surface. A second set of tabs 36D are arranged in between the first set of tabs 36C so that the first and second set of tabs 36C, 36D form an alternating pattern along the length of the planar fin surface 34, the second set of tabs 36D being bent or lifted out of the planar fin surface 34 in a direction opposite to that of the first set of tabs 36C. The same alternating pattern of tabs 36C, 36D is formed in the adjacent planar fin surfaces 34 so that the tabs 36C, 36D can nest within the corresponding opening formed in the adjacent planar fin surface 34 as in the previously described embodiment. Accordingly, the increased fin density can be achieved with the triangular tabs 36C, 36D being arranged in the alternating pattern.

While the exemplary embodiments of the subject heat transfer surface 12 have all been described in relation to triangular or delta wing tabs 36, it will be understood that other shapes of tabs are also contemplated with the scope of the present disclosure. More specifically, curved tabs 52 may also be formed in the planar fin surfaces 34 of the heat transfer surface 12 in any of the various patterns described above (i.e. staggered arrangement; cascaded arrangement; bi-directional arrangement; alternating directions, etc). The curved tabs 52 are formed in a similar fashion to the triangular tabs 36 described above with their rounded or curved edge 53 lifted out of the plane of the planar fin surface 34 and arranged at an angle of attack to the incoming flow 41 upstream of the attached base 54. While curved tabs 52 may not necessarily form the same counter-rotating vortices in the fluid flowing over the heat transfer surface 12 as discussed above in connection with the triangular or delta wing tabs 36, the curved tabs 52 have also been found to create vortices in the fluid flow that serve to disrupt boundary layer growth over the surface of the fin 12 which has been found to contribute to overall increased heat transfer performance. Curved tabs 52 can also be nested within the openings formed by the corresponding curved tabs 52 formed in the adjacent planar fin surface 34 in order to achieve the increased fin density which also serves to increase overall heat transfer performance.

Figure 12A:
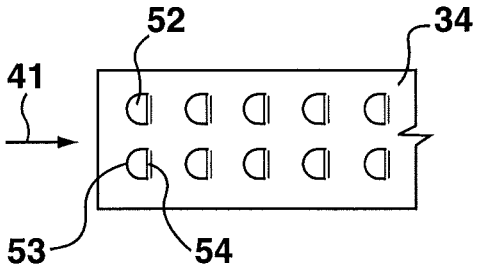
FIGS. 12A-12E are schematic drawings illustrating various other shapes of heat transfer augmenting tabs that can be incorporated into the heat transfer surface according to the present disclosure.
Figure 12B:
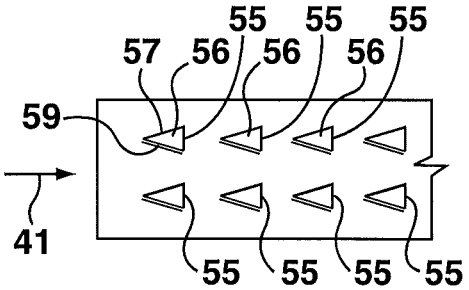
Figure 12C:
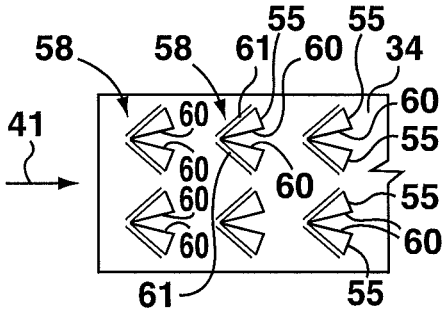

Delta winglets 56 and/or split triangular tabs 58 are another variation of tabs that can be incorporated into the subject heat transfer surface 12. Delta winglets 56 are triangular in shape but rather than having the tip 38 lifted out of the planar fin surface 34 as in the previously described embodiments, the triangular tab 56 is lifted out of the plane of the planar fin surface 34 along one of its edges 57 and along the shorter base side 55 of the triangular tab with the opposite edge 59 serving as the attached base as shown in FIG. 12B. Split triangular tabs 58 are formed by splitting or cutting a triangular tab down the middle as shown in FIG. 12C and lifting the cut or split edge 60 and shorter base edge 55 of the split triangular tab out of the plane of the planar fin surface 34 with the opposed edge 61 of the split triangular tab 58 serving as the attached base. Accordingly, the split triangular tabs 58 essentially comprise two delta winglets 56. Once again, the delta winglets 56 and the split triangular tabs 58 can be arranged in any of the various patterns described above and are also capable of nesting within the openings formed in the adjacent planar fin surface 34 so as to achieve increased fin density for the heat transfer surface 12.

Figure 12D:
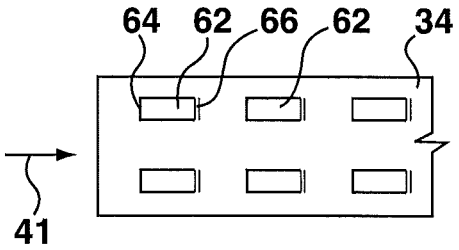
Figure 12E:
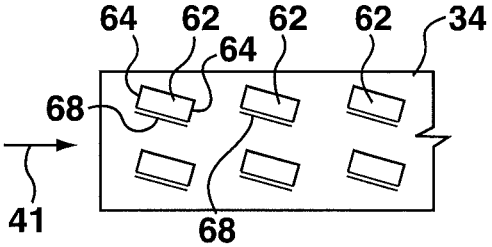

Rectangular tabs 62 that are lifted out of the planar fin surface 34 so that their tips 64 are arranged at an angle to the incident flow as shown schematically, for example, in FIG. 12D are also contemplated within the scope of the present disclosure. The rectangular tabs 62 can be arranged so as to have one free end 64 of the rectangular tab 62 lifted out of the plane of the planar fin surface 34 with the end 64 being upstream of the attached base 66. Alternatively, the rectangular tabs 62 can be arranged so as to have one of the longitudinal edges 68 of the rectangular tab 62 serve as the attached base with the opposed longitudinal edge 68 and shorter end edges 64 being lifted out of the plane of the planar fin surface 34 as shown schematically in FIG. 12E. Once again, rectangular tabs 62 can be arranged in any of the various patterns described above and are also capable of nesting within the openings formed in the adjacent planar fin surface 34 so as to achieve increased fin density for the heat transfer surface 12.

The various embodiments of the heat transfer surface 12 described above appear to provide for improved overall heat transfer performance of a heat exchanger while offering a lower pressure drop across the heat transfer surface 12 as compared to the more traditional louvered fin. By lowering the pressure drop across the fin or heat transfer surface 12 in addition to demonstrating increased heat transfer performance, heat transfer surface 12 appears to be potentially well-suited for charge-air cooler (CAC) applications. More specifically, it appears that by reducing pressure drop or pressure losses across the heat transfer surface 12, the required turbocharger pressure ratio (or supercharger pressure) can also be reduced which in turn appears to reduce heating due to compression of the air flowing through the device which further reduces the load on the CAC. These characteristics are often highly desirable for many automotive intake systems where any improvement in efficiency is often found to be highly desirable. While the heat transfer surface 12 described herein may be well-suited for CAC applications, it will be understood that the subject heat transfer surface 12 is not limited to CAC applications and is also not necessarily limited to use as an air-side fin. For instance, heat transfer surface 12 may also be used inside tubular fluid flow channels for the flow of a liquid therethrough.

Figure 19:
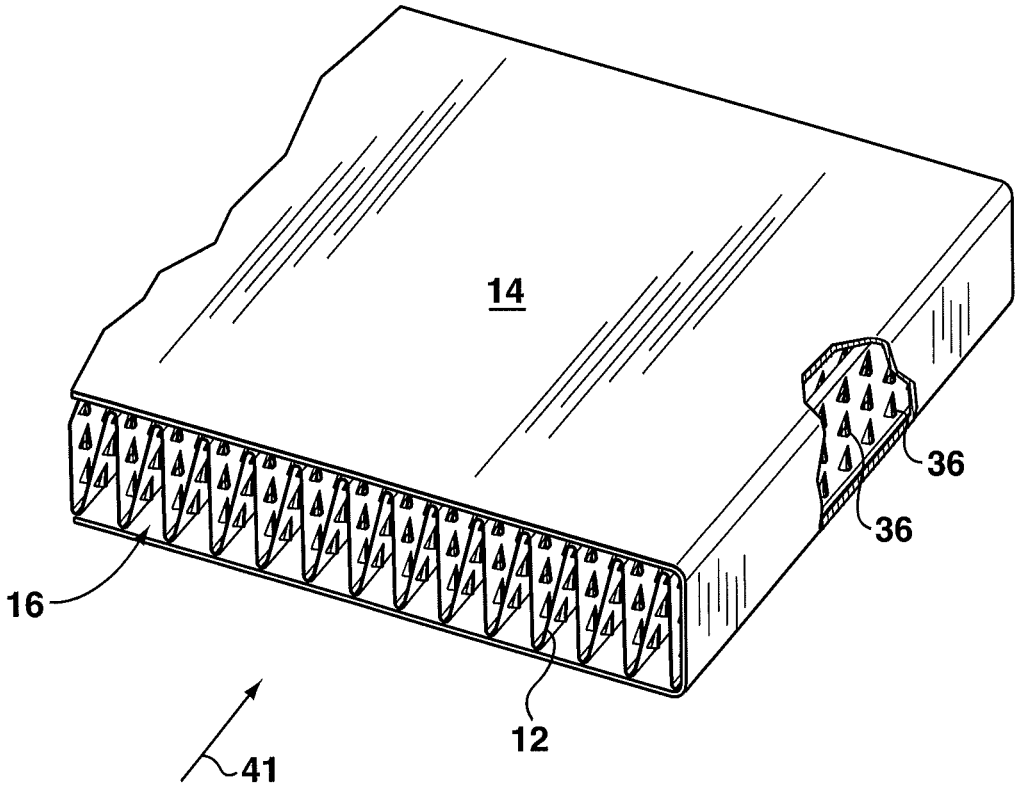
FIG. 19 is a perspective view of a portion of a heat exchanger or heat exchanger tube containing an example embodiment of a heat transfer surface according to the present disclosure.

While the various embodiments of the heat transfer surface 12 have primarily been described in relation to use between the spaced apart tubular members 14 of a heat exchanger, e.g. for use as an air-side fin, it will be understood that the same heat transfer surface 12 can also be appropriately dimensioned for use within the tubular members 14, as shown for instance in FIG. 19, in order to increase turbulence and/or disrupt boundary layer growth within the fluid flowing through flow passages 16. While tubular member 14 is shown as a being formed by a one-piece tubular member, it will be understood that it may also be formed by mating plate pairs. As well, while tubular member 14 is shown as having opposed, open ends for the flow of a fluid therethrough, it will be understood that the tubular member may be formed with a closed or sealed peripheral edge, the flow passage 16 being fed by means of fluid inlet/outlet openings formed therein that communicate with corresponding fluid inlet/outlet openings in adjacent tubular members 14 forming the heat exchanger.

While various exemplary embodiments of the heat transfer surface 12 have been described and shown in the drawings, it will be understood that certain adaptations and modifications of the described exemplary embodiments can be made as construed within the scope of the present disclosure. Therefore, the above discussed embodiments are considered to be illustrative and not restrictive.

What is claimed is:

1. A heat transfer surface for a heat exchanger comprising:

a corrugated member having a plurality of parallel, spaced apart upper and lower ridges and planar fin surfaces extending therebetween;

each corrugation of said corrugated member comprising either an upper or lower ridge and two planar fin surfaces extending from the corresponding upper or lower ridge;

the planar fin surfaces being formed with a plurality of spaced apart tabs, each tab having one attached base and a free end projecting out of the plane of the corresponding planar fin surface, wherein the tabs are triangular, each said tab having a tip in the form of said free end;

a plurality of triangular openings formed in the planar fin surfaces, the plurality of openings formed by the tabs projecting out of the planar fin surface;

wherein the free ends of the tabs formed in one of the planar fin surfaces extend into the openings formed in an adjacent planar fin surface;

wherein the free end of each said tab is attached to the planar fin surface only through said one attached base;

wherein the heat transfer surface has a leading edge with respect to a direction of incoming flow defined by an end edge of the planar fin surfaces; and wherein the tip of each said tab is oriented toward the leading edge relative to the attached base.

2. The heat transfer surface as claimed in claim 1, wherein the planar fin surfaces are formed with a plurality of rows of spaced apart tabs, the rows extending along the length of the planar fin surface.

3. The heat transfer surface as claimed in claim 2, wherein adjacent rows of spaced apart tabs are staggered with respect to one another.

4. The heat transfer surface as claimed in claim 2, wherein the rows of spaced apart tabs are arranged in a cascading pattern.

5. The heat transfer surface as claimed in claim 1, wherein the free ends of the tabs formed in one planar fin surface project out of the plane of the planar fin surface in a first direction, the free ends of the tabs formed in an adjacent planar fin surface projecting out of the plane of the planar fin surface in the same first direction.

6. The heat transfer surface as claimed in claim 2, wherein the rows of spaced apart tabs each comprise a first set of tabs that project out of the plane of the planar fin surface in a first direction and a second set of tabs that project out of the planar fin surface in a second direction.

7. The heat transfer surface as claimed in claim 1, wherein the tabs have varying size.

8. The heat transfer surface a claimed in claim 1, wherein the tabs are arranged at varying angles with respect to the direction of incoming flow.

9. The heat transfer surface as claimed in claim 1, further comprising flow accelerating features formed in the planar fin surface intermediate the spaced-apart tabs, wherein the flow accelerating features comprise rounded protrusions formed between the spaced apart tabs proximal to the attached base.

10. The heat transfer surface as claimed in claim 1, wherein the planar fin surfaces are one of the following alternatives: parallel to one another or inclined with respect to one another.

11. The heat transfer surface as claimed in claim 1, wherein the upper and lower ridges are one of the following alternatives: rounded or generally flat surfaces.

12. The heat transfer surface as claimed in claim 1, wherein said heat transfer surface is arranged within enclosed tubular members for the flow of a fluid therethrough.

13. A heat exchanger comprising:

a plurality of stacked tubular members extending in spaced apart generally parallel relationship;

a first set of fluid flow passages defined by said plurality of stacked tubular members;

a second set of fluid flow passages formed between adjacent tubular members;

a pair of inlet and outlet manifolds in communication with said first set of fluid flow passages;

a plurality of heat transfer surfaces disposed in said second set of fluid passages between adjacent tubular members;

each of said heat transfer surfaces comprising:

a corrugated member having a plurality of parallel, spaced apart upper and lower ridges and planar fin surfaces extending therebetween;

each corrugation of said corrugated member comprising either an upper or lower ridge and two planar fin surfaces extending from the corresponding upper or lower ridge;

the planar fin surfaces being formed with a plurality of spaced apart tabs, each tab having one attached base and a free end projecting out of the plane of the corresponding planar fin surface, wherein the tabs are triangular, each said tab having a tip in the form of said free end;

a plurality of triangular openings formed in the planar fin surfaces, the plurality of openings formed by the tabs projecting out of the planar fin surface;

the free ends of the tabs formed in one of the planar fin surfaces extending into the openings formed in an adjacent planar fin surface;

wherein the free end of each said tab is attached to the planar fin surface only through said one attached base;

wherein the heat transfer surface has a leading edge with respect to a direction of incoming flow defined by an end edge of the planar fin surfaces; and wherein the tip of each said tab is oriented toward the leading edge relative to the attached base.

14. The heat exchanger as claimed in claim 13, wherein the heat transfer surface is bi-directional such that each planar fin surface comprises a first portion wherein the tabs are formed with their free end oriented toward the leading edge relative to the attached base, and a second portion wherein the tabs are formed with their free end oriented toward a second leading edge relative to the attached base.

15. The heat exchanger as claimed in claim 13, wherein the planar fin surfaces are formed with a plurality of rows of spaced apart tabs, the rows extending along the length of the planar fin surface; and wherein the rows of spaced apart tabs each comprise a first set of tabs that project out of the plane of the planar fin surface in a first direction and a second set of tabs that project out of the planar fin surface in a second direction thereby forming an alternating pattern along the length of the planar fin surface.

* * * * *